US007914392B2

(12) United States Patent
Elliott

(10) Patent No.: US 7,914,392 B2
(45) **Date of Patent: *Mar. 29, 2011**

(54) GOLF PRACTICE SYSTEM, METHOD AND APPARATUS

(75) Inventor: Deane O. Elliott, Woodbridge, VA (US)

(73) Assignee: Deane O. Elliott, Woodbridge, VA (US)

( * ) Notice: Subject to any disclaimer, the term of this patent is extended or adjusted under 35 U.S.C. 154(b) by 736 days.

This patent is subject to a terminal disclaimer.

(21) Appl. No.: 11/808,420

(22) Filed: Jun. 8, 2007

(65) Prior Publication Data

US 2007/0243942 A1 Oct. 18, 2007

Related U.S. Application Data

(63) Continuation-in-part of application No. 11/102,808, filed on Apr. 11, 2005, now Pat. No. 7,228,649.

(60) Provisional application No. 60/564,218, filed on Apr. 22, 2004, provisional application No. 60/880,371, filed on Jan. 16, 2007.

(51) Int. Cl.
*A63B 53/16* (2006.01)

(52) U.S. Cl. ..... 473/270; 473/271; 473/272; 473/273

(58) Field of Classification Search ..... 473/270–273
See application file for complete search history.

(56) References Cited

U.S. PATENT DOCUMENTS

| | | | | |
|---|---|---|---|---|
| 2,571,974 | A | 10/1951 | Walker | |
| 3,009,704 | A | 11/1961 | Heard | |
| 3,041,075 | A * | 6/1962 | Taylor | 473/218 |
| 3,796,434 | A | 3/1974 | Moss et al. | |
| 5,381,614 | A | 1/1995 | Goldstein | |
| 5,409,232 | A | 4/1995 | Hoganson | |
| 5,435,727 | A | 7/1995 | Dobson | |
| 5,482,283 | A | 1/1996 | Wall | |
| 5,529,305 | A | 6/1996 | Wu | |
| 5,697,791 | A | 12/1997 | Nashner et al. | |
| 6,089,989 | A | 7/2000 | Sutcliffe | |
| 6,227,983 | B1 | 5/2001 | Yang | |
| 6,375,579 | B1 | 4/2002 | Hart | |
| 6,408,545 | B1 | 6/2002 | Song | |
| 6,416,327 | B1 | 7/2002 | Wittenbecher | |
| 6,702,690 | B1 | 3/2004 | Albright | |

(Continued)

FOREIGN PATENT DOCUMENTS

JP 10137381 A 5/1998

(Continued)

*Primary Examiner* — Corbett B Coburn
(74) *Attorney, Agent, or Firm* — Berenato & White, LLC

(57) ABSTRACT

The present invention is directed to a golf practice system having a practice mat and first and second alignment devices. The first alignment device has a first light emitting device rotatably attached to a first housing and rotatable about a vertical axis. The first alignment device is secured proximate a first side of the mat. The first light emitting device projects a first light beam in a straight line extending outwardly in an adjustably selected first direction and defines a first visible reference line. The second alignment device has a second light emitting device rotatably attached to a second housing and rotatable about a vertical axis. The second alignment device is secured proximate a second side of the mat. The second light emitting device projects a second light beam in a straight line extending outwardly in an adjustably selected second direction and defines a second visible reference line.

20 Claims, 15 Drawing Sheets

U.S. PATENT DOCUMENTS

| | | | | |
|---|---|---|---|---|
| 6,921,340 | B2 | 7/2005 | Dickie | |
| 6,923,728 | B1 | 8/2005 | Lin | |
| 7,025,688 | B1 * | 4/2006 | Hatzikostantis | 473/220 |
| 7,112,144 | B2 | 9/2006 | Mindlin | |
| 7,112,145 | B2 | 9/2006 | Gaddy | |
| 7,134,966 | B1 | 11/2006 | Tice | |
| 2001/0041623 | A1 | 11/2001 | Rosselli | |
| 2004/0132555 | A1 | 7/2004 | Forrest | |
| 2005/0096146 | A1 | 5/2005 | Burley | |
| 2005/0153784 | A1 | 7/2005 | Burgin | |
| 2005/0239568 | A1 * | 10/2005 | Stringer | 473/270 |
| 2006/0040757 | A1 | 2/2006 | Rosselli | |

FOREIGN PATENT DOCUMENTS

| | | | |
|---|---|---|---|
| JP | 2004073436 | A | 3/2004 |
| WO | WO 01/89638 | | 11/2001 |

* cited by examiner

GOLF PRACTICE SYSTEM, METHOD AND APPARATUS

CROSS REFERENCE TO RELATED APPLICATION AND CLAIM TO PRIORITY

This application is a continuation-in-part of U.S. patent application Ser. No. 11/102,808, filed Apr. 11, 2005, now U.S. Pat. No. 7,228,649, and entitled "Golf Alignment Device, Method and Apparatus," which is based on provisional application Ser. No. 60/564,218, filed Apr. 22, 2004, by Deane O. Elliot, the disclosures of which are incorporated herein by reference and to which priority is claimed under 35 U.S.C. §§120 and 119(e)(1).

This application is also based on provisional application Ser. No. 60/880,371, filed Jan. 16, 2007, titled "Golf Ball Positioning Practice Device, Method and Apparatus", by Deane O. Elliott, the disclosure of which is incorporated herein by reference and to which priority is claimed under 35 U.S.C. §119(e)(1).

FIELD OF THE INVENTION

The present invention is directed to a golf practice system having a practice mat, and first and second alignment devices. The first alignment device has a first light emitting device rotatably attached to a first housing and rotatable about a vertical axis. The first alignment device is secured to the mat proximate a first side. The first light emitting device projects a first light beam in a straight line extending outwardly in an adjustably selected first direction and defining a first visible reference line. The second alignment device has a second light emitting device rotatably attached to a second housing and rotatable about a vertical axis. The second alignment device is secured to the mat proximate a second side. The second light emitting device projects a second light beam in a straight line extending outwardly in an adjustably selected second direction and defining a second visible reference line.

BACKGROUND OF THE INVENTION

The game of golf includes many "basics" that can make the game difficult if not grasped by the player. For example, proper grip, posture, stance, alignment and ball position may all affect a player's performance. There are many schools of thought with regard to ball position for a golfer. For example, golf students are sometimes taught to play every shot from the center of their stance, regardless of the club being used. Other instructors may teach the students to play every shot approximately 1 to 2 inches off their left heel (for right handed golfers). Other instructors may advise their students to move the ball placement from the center of the stance towards the left heel as club length increases. Unless the student is standing in front of a mirror or working directly with the instructor, it is often difficult for a student to determine whether the ball is properly positioned and aligned relative to his or her feet.

Various training devices, systems and methods have been developed for the game of golf in an effort to improve one's skill level. Some systems focus on proper ball position in relation to a player's stance. Some such systems include a mat with a first set of markings and/or lines thereon for aligning a player's feet, which correspond with a second set of markings for aligning a golf ball. Other devices provide a T-shaped or cross-shaped device having a first elongated measuring stick having markings for aligning a player's foot, and a second elongated stick perpendicular to the measuring stick for aligning the ball. Other devices include an elongated aiming rod that is secured to the shoe of the player. Such mats, measuring stick devices and aiming rods are relatively bulky and often difficult to set up and transport. In addition, many are impractical for use on a golf course. Furthermore, the markings or lines typically cannot be adjusted to account for different golfing styles.

Other systems provide a series of stripes disposed on a pair of golf shoes. The golfer may bring his or her feet close together so that the stripes on the left shoe are aligned with the stripes on the right shoe. Such systems are not as bulky as mats or elongated sticks. However, the reference lines provided on such shoes only provide an alignment line that is as long as the width of the golfer's shoes. Thus, such alignment markings do not provide an overly accurate or helpful reference line for aligning the golfer with the target. In addition, the lines on the shoes are not adjustable, and therefore may only be helpful for use with some clubs.

Relatively complex training systems have also been developed which monitor a player's movement when swinging a club. For example, some systems include a platform housing a tee manipulation mechanism which includes a plurality of transmitters for transmitting infrared beams along predetermined paths defining a three-dimensional space within the platform. The beams are positioned so that improper club or body position may be sensed by the system. The information may trigger a status light board, or it may be processed by a microprocessor for detailed analysis of the golfer's swing. Some such systems also include a video camera for additional analysis of the golfer's form. Other systems include a laser source coupled to an optics system remote from a player. A line of light is produced which is then aligned with the target path. The player is intermediate the system and target, and aligns the ball and club using the line of light. While such systems may provide feedback for a golfer, they are complicated and expensive. In addition, such systems are not for use on a course.

Other systems include a laser device that is used in conjunction with a mat. The mat includes a series of lines. The laser device is removably affixed to the player's clothes. The device projects a laser beam outwardly from the golfer, which is aligned with the lines on the mat. As noted above, systems requiring a mat are bulky and impractical for use on a course.

Other systems provide a laser device that is removably affixed to the player's clothes, and emits a laser beam toward the target. However, such devices are often inaccurate because they fail to provide a consistent reference line for the golfer. The orientation of the reference will change if the device is affixed to different positions on the golfer's clothes. Even if the device is affixed in the same position on the golfer's clothes each time, clothing such as pants and shirts typically move and flex as the golfer moves, or due to windy conditions. As such, the reference line emitted from the laser device moves as the golfer moves. Furthermore, such devices typically fail to provide for adjustment depending on the club being used, the desired ball position, and the specific playing style unique to a particular golfer.

Other training systems include a hand-held laser device that projects an I-shaped pattern on the ground in front on a player, having first and second parallel lines connected by an intermediate line perpendicular thereto. The player aligns his or her feet with an inner line. The ball is aligned with an outer line. While such laser devices are relatively portable, they do not provide an overly accurate system for ball and foot alignment given the projected pattern varies depending on how the golfer is holding the device. For example, the golfer must accurately align the pattern on the ground by holding the device the proper distance from his or her body. In addition, the device must be held at a proper angle. Typically, a golfer tires as the game progresses. In addition to focusing on the basics of the game, the golfer must now also focus on proper use of the handheld laser device. Any variation in position and angle of the device relative to the golfer and the ball may adversely affect proper alignment and ball position. Thus, such systems have not proven reliable or helpful for most golfers.

Other systems provide a laser device that may be attached to the player so that the laser beam is directed to a point on the ground in front of the golfer's feet. For example, the device may be clipped to the hat of the golfer. The beam is pointed at the ball or a reference point on the ground. Such devices attempt to aid the golfer in keeping his or her head down throughout the swing by providing the golfer a reference point on which to focus during the swing. However, such systems typically fail to provide a reference line for aligning the target. In addition, any movement of the golfer's head will change the position of the reference point. The golfer creates the reference point by simply positioning his or her head or moving the laser device. However, no guidance is provided as to whether the correct reference point is being created. In addition, such devices do not aid a golfer in aligning with the target, achieving proper ball position, or maintaining proper stance.

Various systems include a laser device that is mounted over the club head or integral with the club head. The device projects a laser beam perpendicular to the striking face. The beam is aligned with the target. However, the beam will move as the club head moves. Thus, such devices are typically provided on a putter, since putting usually involves only a limited range of club motion compared to other clubs. Even for use on a putter, such devices are not overly accurate since the club head will move. In addition, if the golfer is not properly gripping the club, the reference line created by the beam will not be accurate. For example, if the club face is "open", the beam will not be correctly aligned with the target.

Therefore, there is a need for a golf alignment device and system that solves some or all of the above-noted problems.

SUMMARY OF THE INVENTION

The disclosed invention aids a golfer in achieving and maintaining proper alignment with respect to a target line and/or a reference line. The disclosed invention generates a visible, audible and/or tactile response indicating when a golfer is properly aligned with respect to the intended target line and/or the golf ball.

One of the more difficult aspects of golf for many golfers is mastering ball position with respect to the golfer's stance. For example, ball position for each of the most commonly-used woods (i.e. the driver, the 3-wood, and the 5-wood) varies according to most schools of thought. As the length of the shaft of the wood increases, the preferred ball position typically moves toward the lead foot of the golfer. However, it is often difficult for a golfer to know whether or not he or she is properly aligned with the ball during set-up. An embodiment of the present invention aids the golfer achieving proper ball position by projecting a light beam toward the tee or the ball at a predetermined angle relative to the golfer's lead foot.

A golf alignment system according to another embodiment of the present invention includes first and second shoes forming a pair. The first shoe has at least one transmitter disposed on an instep portion thereof. The transmitter transmits a signal. The second shoe has at least one receiver disposed on an instep portion thereof. The receiver is activated by the signal when the first shoe is in a predetermined position relative to the second shoe. The system also includes a sensor in communication with the receiver, which senses activation of the receiver. The sensor generates a command signal if the receiver is activated. An indicator is in communication with the sensor. The indicator is actuated after receiving the command signal.

A golf alignment system according to another embodiment includes first and second shoes forming a pair. The first shoe has a light emitting device disposed on an instep portion thereof. The light emitting device projects a light beam in a straight line extending outwardly from the instep portion. The second shoe has at least one reference mark disposed on an instep thereof for aligning the light beam therewith. The first shoe is in a predetermined desired position relative to the second shoe when the light beam is aligned with the reference mark.

A golf alignment system according to another embodiment includes a pair of golf shoes having a first shoe and a second shoe. A light emitting device is pivotally attached to the first shoe. The light emitting device projects a light beam in a straight line extending outwardly in an adjustably selected first direction.

The present invention is also directed to a visible light generating means secured to a shoe. The visible light generating means projects visible indication information with respect to one of a target and a target line.

The present invention is also directed to a golf practice system having a practice mat and first and second alignment devices. The first alignment device has a first light emitting device rotatably attached to a first housing and rotatable about a vertical axis. The first alignment device is secured to a first zone proximate a first side of the mat. The first light emitting device projects a first light beam in a straight line extending outwardly in an adjustably selected first direction and defines a first visible reference line. The second alignment device has a second light emitting device rotatably attached to a second housing and rotatable about a vertical axis. The second alignment device is secured to a second zone proximate a second side of the mat. The second light emitting device projects a second light beam in a straight line extending outwardly in an adjustably selected second direction and defines a second visible reference line.

A method of positioning and aligning a golf ball is also disclosed. A first alignment device is provided having a light emitting device rotatably attached to a base. The light emitting device projects a light beam in a straight line extending outwardly therefrom and defining a first visible reference line. A second alignment device is provided having a light emitting device rotatably attached thereto. The light emitting device projects a light beam in a straight line extending outwardly therefrom and defines a second visible reference line. The first and second light emitting devices are rotated about vertical axis to predetermined positions, so that the first and second visible reference lines intersect at an intersection point. A golf ball is positioned relative to the intersection point.

DETAILED DESCRIPTION OF THE INVENTION

Figure 1:
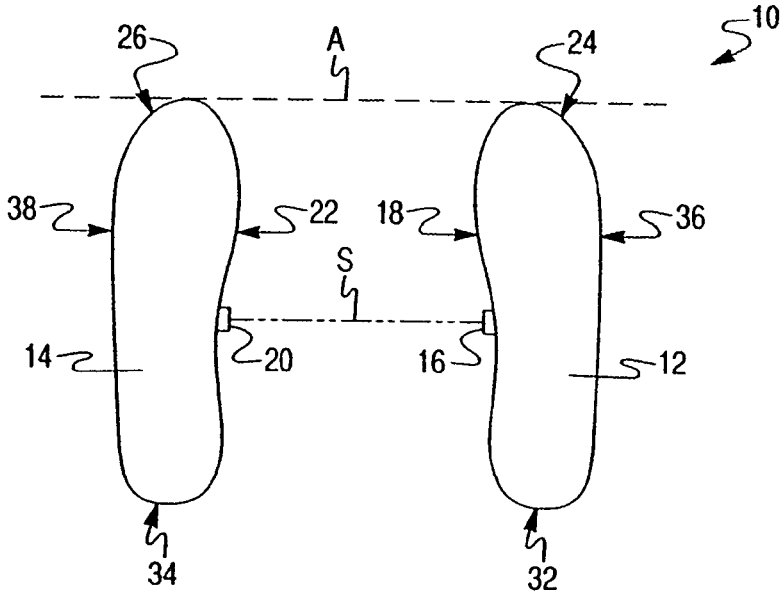
FIG. 1 is a schematic view of a golf alignment system according to a first embodiment of the present invention, with an alignment line and a signal path shown in phantom.
Figure 2:
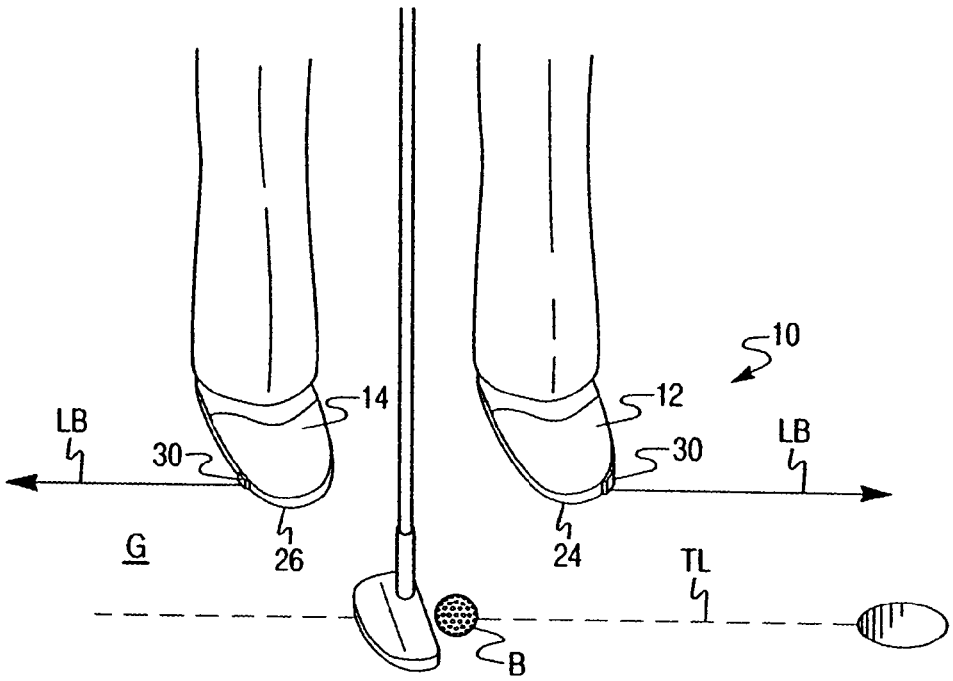
FIG. 2 is a perspective fragmentary view of a golfer's legs and feet using the golf alignment system according to the first embodiment, with a target line shown in phantom.

A golf alignment system 10 according to a first embodiment of the present invention is best shown in FIGS. 1 and 2. System 10 includes first and second golf shoes 12, 14 forming a pair. A transmitter 16 is disposed on an instep portion 18 of first golf shoe 12. A receiver 20 is disposed on an instep portion 22 of second golf shoe 14. Transmitter 16 transmits a signal (shown by dashed line S in FIG. 1) which activates receiver 20 when first shoe 12 is in a predetermined position relative to second shoe 14. Transmitter 16 may transmit a radio frequency signal which activates receiver 20. Alternatively, transmitter 16 may transmit a light beam, such as a laser beam; receiver 20 may include a light sensor which is activated by the light beam transmitted by transmitter 16. For example, receiver 20 may be activated by the transmitted signal when first and second shoes 12, 14 are aligned in a 'square' set-up position, wherein the toe portions 24, 26 of first and second shoes 12, 14, respectively, are aligned (as shown by dashed line A in FIG. 1) and parallel to a target line (as shown by dashed line TL in FIG. 2).

Receiver 20 is in communication with a sensor, or includes an integral sensor component, which senses activation of receiver 20. The sensor generates a command signal upon activation of receiver 20. The sensor is in communication with an indicator device, and transmits the command signal to the indicator. The indicator device is actuated upon receipt of the command signal. Upon actuation, the indicator device provides an audible, visible and/or tactile indication that transmitter 16 is aligned with receiver 20 in the predetermined position. Additionally, receiver 20 and transmitter 16 may be adjusted so that the indicator device is actuated when receiver 20 and transmitter 16 are spaced by a predetermined distance (e.g. when a player's feet are spaced by a predetermined desired distance).

Figure 3:
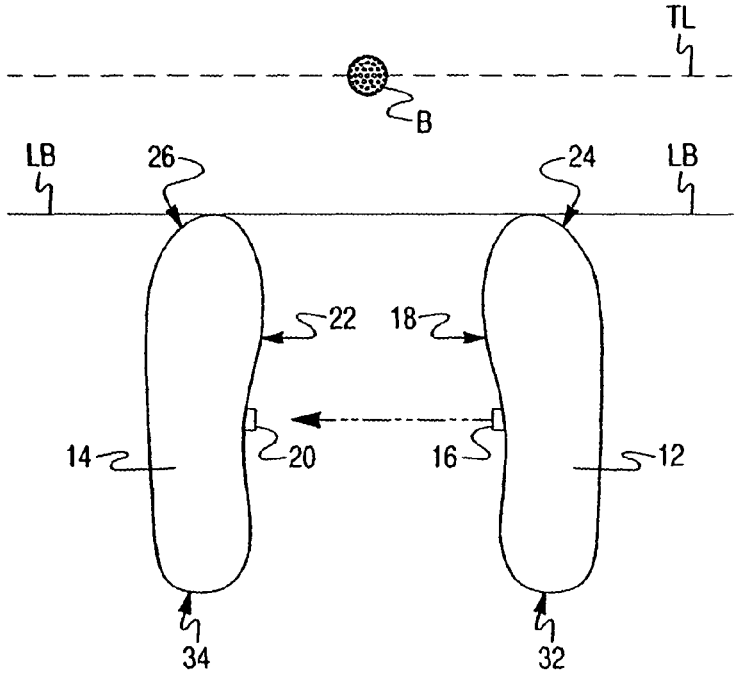
FIG. 3 is a schematic view of a golf alignment system according to another embodiment, with the target line shown in phantom.
Figure 4:
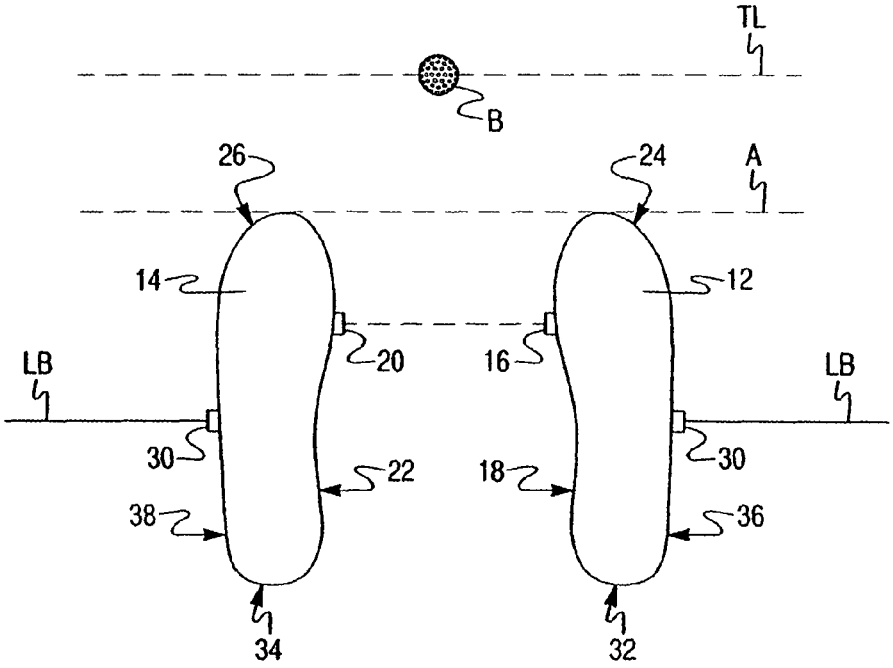
FIG. 4 is a schematic view of a golf alignment system according to another embodiment, with the alignment and target lines shown in phantom.

The indicator device is preferably a light emitting device 30 which projects a light beam LB (e.g. a laser beam) along the ground G in a straight line. Light emitting device 30 may be attached to one or both of first and second shoes 12, 14. As best shown in FIG. 2, light emitting device 30 is preferably attached proximate toe portions 24, 26 of first and second shoes 12, 14, respectively. However, light emitting device 30 may also be attached proximate heel portions 32, 34 of first and second shoes 12, 14. Alternatively, light emitting device 30 may be attached proximate one or both outstep portions 36, 38 of first and second shoes 12, 14, as best shown in FIG. 4. Light emitting device 30 may be attached to first and second shoes 12, 14 so that two separate light beams LB are projected on the ground outwardly from first and second shoes 12, 14 in opposite directions when light emitting devices 30 are actuated, as best shown in FIGS. 2 and 4. However, light emitting devices 30 may also be attached to toe portions 24, 26 so that the light beams LB extending from first and second shoes 12, 14 may be aligned to form a single reference line, as best shown in FIG. 3. Alternatively, more than one light emitting device 30 may be provided on each shoe, which thus project two or more parallel lines outwardly from shoe 12 and/or shoe 14. For example, each shoe 12, 14 may include a first light emitting device 30 proximate toe portions 24, 26, and a second light emitting device 30 proximate outstep portions 36, 38.

In the first embodiment, light beams LB from light emitting devices 30 extend outwardly from first and second shoes 12, 14 in a direction substantially perpendicular to instep portions 18, 22, as best shown in FIGS. 2-4. The light beam extending from first shoe 12 may be aligned with the light beam extending from second shoe 14 to aid a player in positioning his feet in the square set up position relative to target line TL. When transmitter 16 and receiver 20 are in proper alignment with one another, light emitting devices 30 are actuated, causing visible light beams LB to emanate outwardly from emitting devices 30 in a straight line proximate the ground, and parallel to the desired target line TL of the golfer. For example, light emitting devices 30 may emit laser beams. The visible line(s) acts as a reference line along which the golfer aligns his or her feet given the reference line is parallel to the target line TL. For example, the visible line may be aligned with a target such as the flag, or aligned parallel to the line the golfer may wish to putt along. In addition, such a visible line aids the golfer in ascertaining whether he or she is aligned to the right or to the left of the desired target. Further, the golfer may align his or her shoulders with the visible line, thereby aiding the golfer in proper shoulder position when addressing the ball B with respect to the intended target line TL.

Figure 4A:
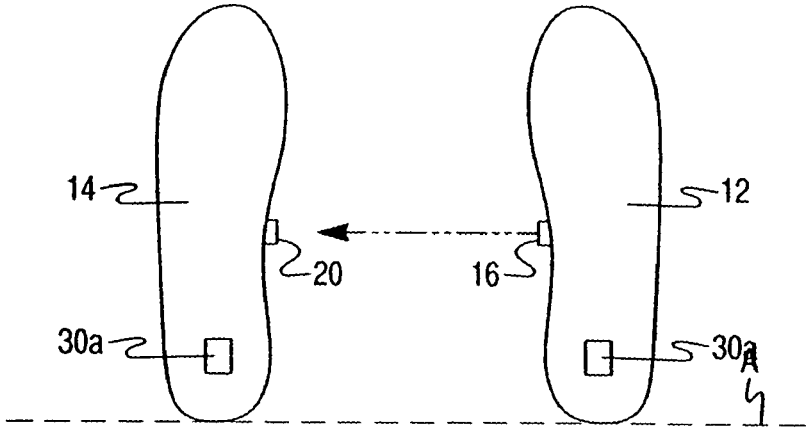
FIG. 4A is a schematic view of a golf alignment system according to another embodiment, with the alignment line shown in phantom.

Alternatively, the indicator device may be a vibrating device 30*a* attached to one or both of first and second shoes 12, 14, as best shown in FIG. 4A. Vibrating device 30*a* may be disposed in the sole of one or both of first and second shoes 12, 14. When transmitter 16 and receiver 20 are in proper alignment with one another, vibrating device 30*a* vibrates so that a golfer feels a slight vibration and is thereby alerted to his or her proper alignment. Other indicator devices may also be incorporated into one or both of first and second shoes 12, 14. For example, the indicator could include a speaker that emits an audible noise upon actuation.

Figure 5:
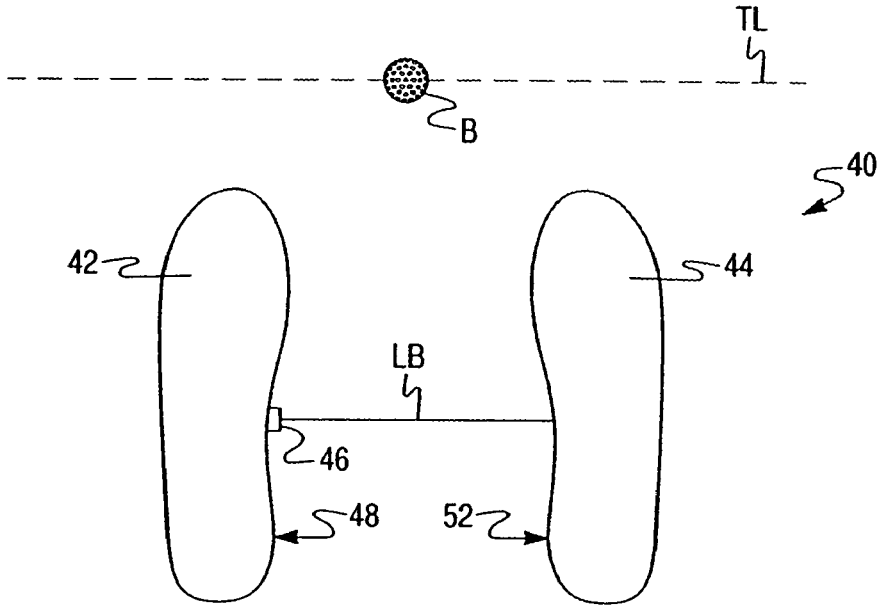
FIG. 5 is a schematic view of a golf alignment system according to another embodiment, with the target line shown in phantom.
Figure 6:
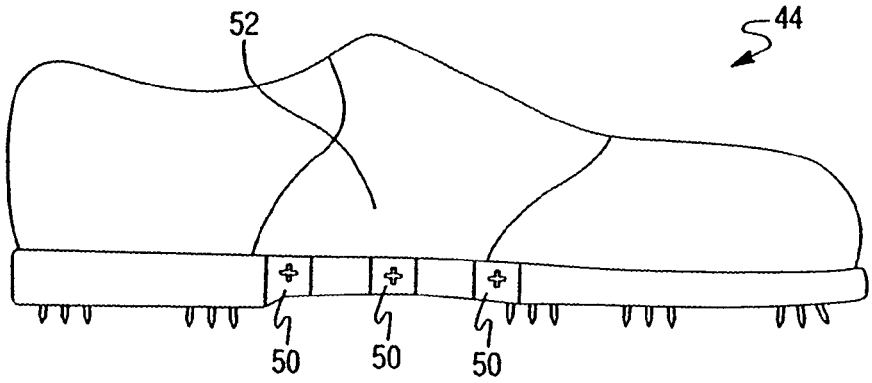
FIG. 6 is a side elevational view of a golf shoe having reference marks thereon according to the embodiment shown in FIG. 5.
Figure 6A:
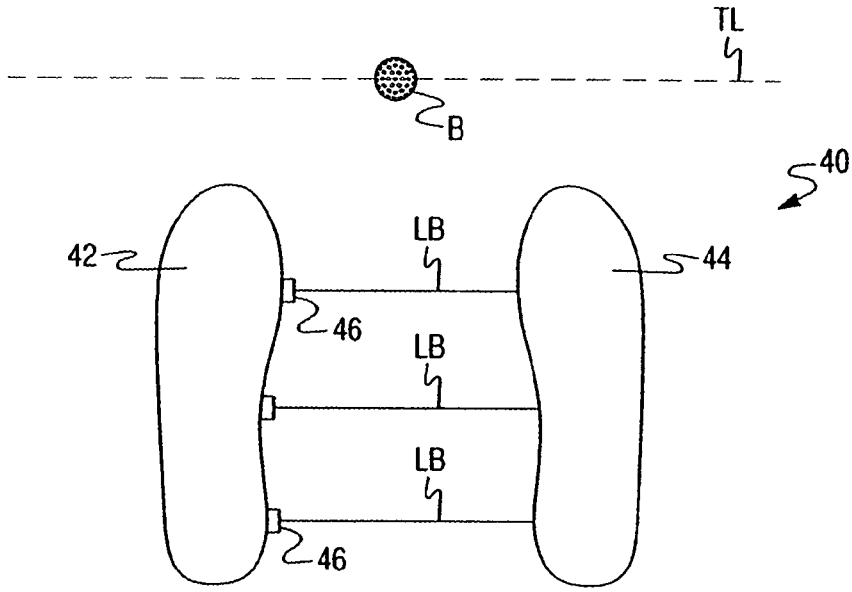
FIG. 6A is a schematic view of a golf alignment system according to another embodiment, with the target line shown in phantom.

A golf alignment system 40 according to a second embodiment is best shown in FIG. 5. System 40 includes first and second golf shoes 42, 44 forming a pair. First shoe 42 includes a light emitting device 46 disposed on an instep portion 48, which projects a light beam LB in a straight line extending outwardly from instep portion 46. Second shoe 44 has a plurality of visual reference marks 50 disposed on an instep portion 52, as best shown in FIG. 6. When the light beam LB is aligned with one of reference marks 50, first shoe 42 is in a predetermined position relative to second shoe 44. First shoe 42 may also include a plurality of light emitting devices 46, wherein each light emitting device 46 emits a light beam that may be aligned with a corresponding reference mark 50, as best shown in FIG. 6A. It should be understood that first shoe 42 may be either a right-footed shoe or a left-footed shoe, depending on the preference of the golfer.

Alignment of light emitting device(s) 46 with reference mark(s) 50 may indicate that a golfer is in a square set up position when addressing the ball B, as best shown in FIGS. 5 and 6A. However, it may also be desirable to provide registration marks 50 that allow the golfer to set up in an "open" or "closed" position. This may be desirable to aid the golfer in aligning his or her feet to promote the ball trajectory in a "fade" or "draw" movement. Thus, the predetermined position need not be the square position.

Figure 7:
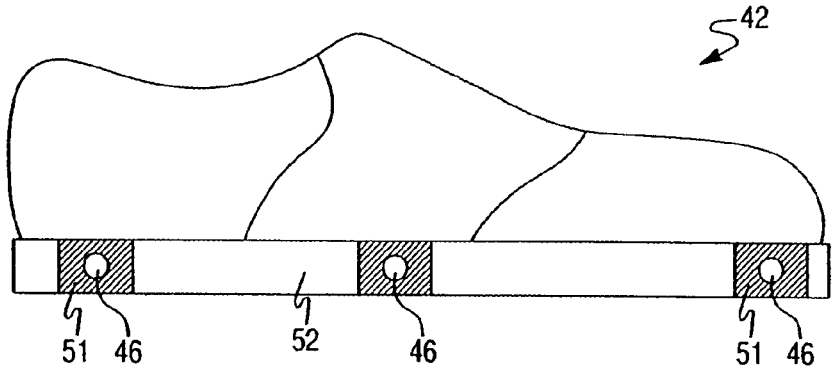
FIG. 7 is a side elevational view of a golf shoe having a sole with light emitting devices integrated therein.
Figure 8:
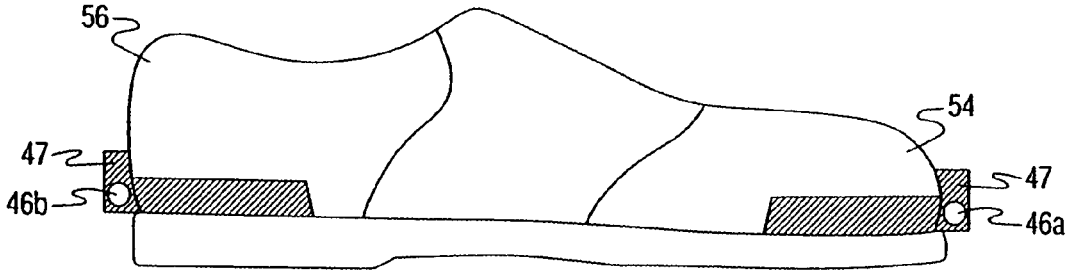
FIG. 8 is a side elevational view of a golf shoe with removably attached light emitting devices according to an embodiment of the present invention.
Figure 9:
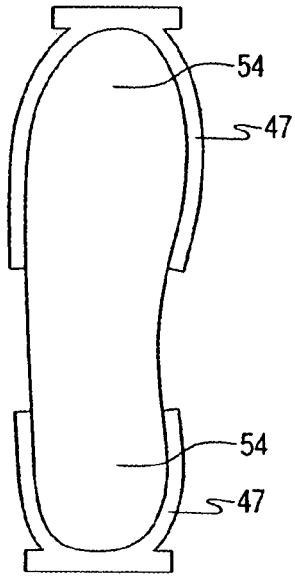
FIG. 9 is a bottom plan view of the golf shoe shown in FIG. 8.

Light emitting device 46 may be an integral part of first shoe 42. For example, a plurality of light emitting devices 46 may be secured within corresponding cavities 51 in the sole 52 of first shoe 42, as best shown in FIG. 7. Alternatively, light emitting device 46 may be removably attached to a shoe. For example, light emitting devices 46*a*, 46*b* may each include a housing 47 that is removably clipped onto either toe and heel portions 54, 56 of a shoe, as best shown in FIGS. 8 and 9.

Figure 10:
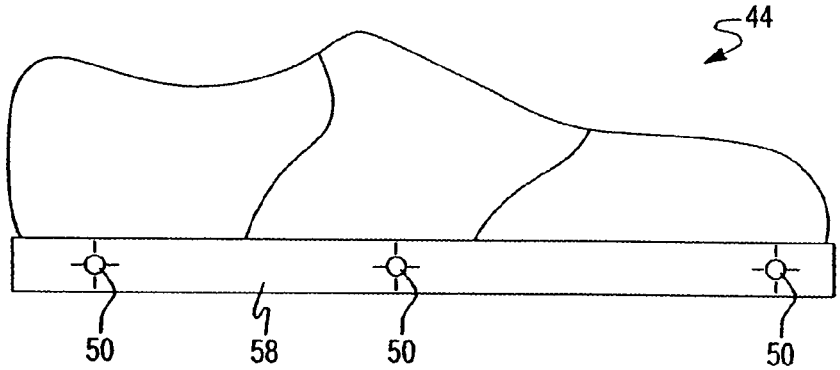
FIG. 10 is a side elevational view of a golf shoe having a sole with reference marks thereon according to another embodiment.
Figure 11:
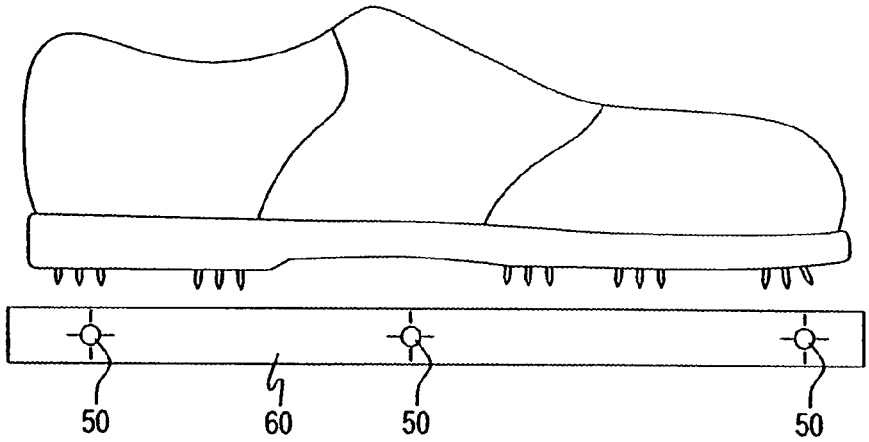
FIG. 11 is a side elevational view of a golf shoe and a platform with reference marks thereon that may be removably attached to the golf shoe.

Likewise, registration marks 50 may be integrally provided on a sole 58 of second shoe 44, as best shown in FIG. 10. Alternatively, a platform 60 may be provided having registration marks 50 therein, which is removably attachable to a shoe, as best shown in FIG. 11.

Figure 12:
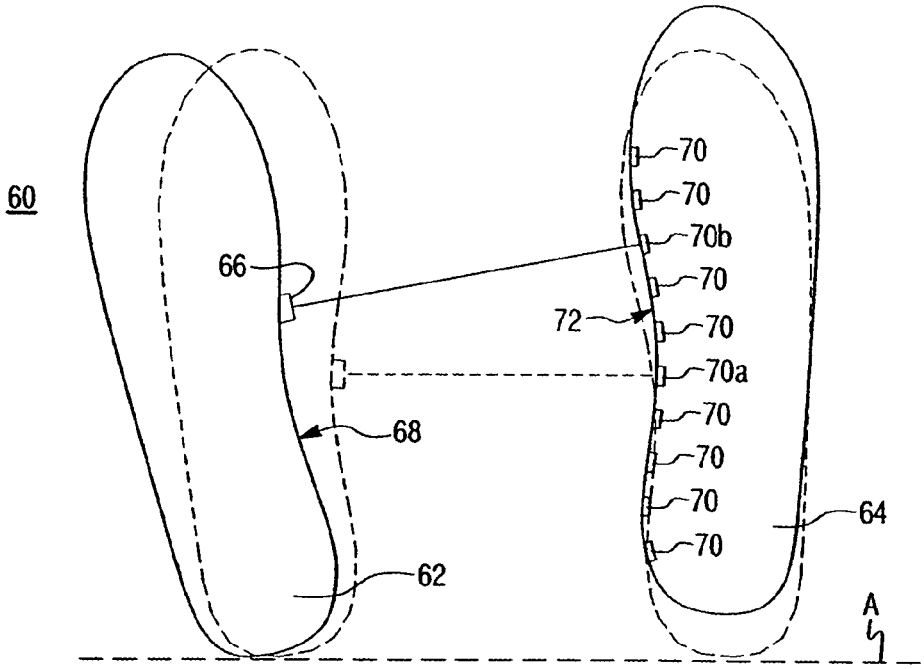
FIG. 12 is a schematic view of a golf alignment system according to another embodiment showing shoes in a first orientation, and shoes in a second orientation shown in phantom.

A golf alignment system 60 according to a third embodiment of the present invention is best shown in FIG. 12. Similar to system 10, system 60 includes first and second golf shoes 62, 64 forming a pair. A transmitter 66 is disposed on an instep portion 68 of first shoe 62. Alternatively, first shoe 62 may also include a two or more transmitters 66 on instep portion 68. Second shoe 64 includes a plurality of receivers 70 disposed on an instep portion 72 thereof. Transmitter(s) 66 transmits a signal which activates a particular receiver 70 depending on the positioning of first shoe 62 relative to second shoe 64. For example, if first and second shoes 62, 64 are in a square position (shown in dashed lines), a central receiver 70*a* is aligned with and activated by transmitter 66. However, if first shoe 62 is splayed outwardly relative to second shoe 64, another particular receiver 70*b* is aligned with and activated by transmitter 66 (shown in solid lines).

Receivers 70 are in communication with a sensor which senses activation of one of receivers 70. The sensor is able to distinguish which particular receiver 70 has been activated. The sensor generates a command signal upon activation of a receiver 70, which is specific to that particular receiver 70.

Figure 13:
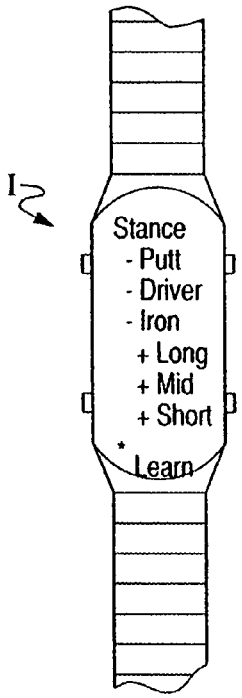
FIG. 13 is a top plan view of an input device for use with the golf alignment system of the present invention.
Figure 14:
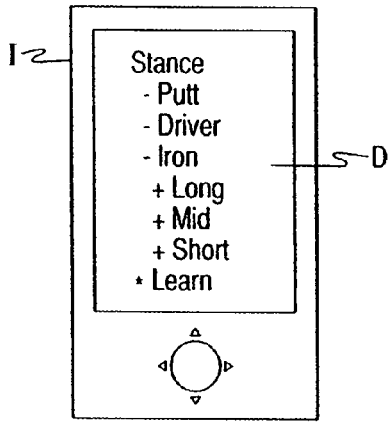
FIG. 14 is a top plan view of another input device for use with the golf alignment system of the present invention.
Figure 15:
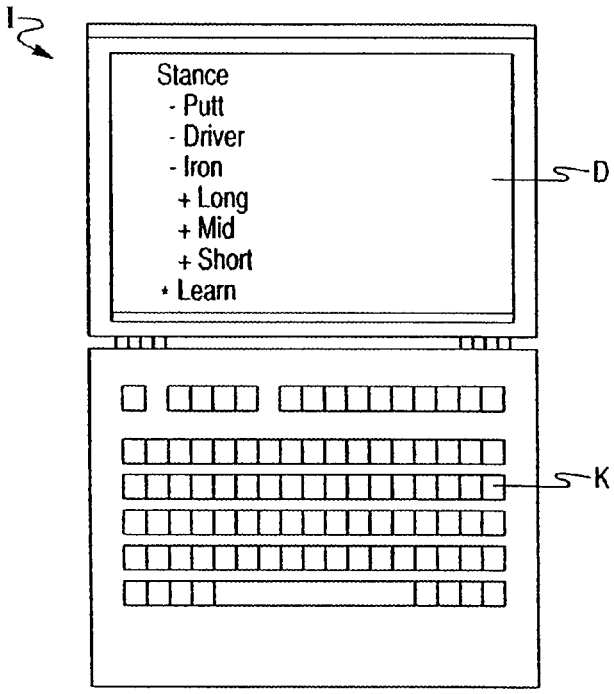
FIG. 15 is a top view of another input device for use with the golf alignment system of the present invention.

The sensor is in communication with an input device I having a microprocessor, such as a wrist or hand-held personal digital assistant, as best shown in FIGS. 13 and 14. Alternatively, input device I may be a laptop or desktop computer, as best shown in FIG. 15. Input device may communicate with the sensor via radio frequency technology, such as Bluetooth® technology, as understood by one skilled in the art. Input device I receives the command signal from the sensor, which indicates which receiver 70 has been activated. Based on the command signal received, input device I is able to determine a position of first shoe 62 relative to second shoe 64.

Input device I preferably includes a display D for displaying the determined position. In one embodiment, input device I displays a recommended golf club corresponding to the determined position. Thus, activation of a particular receiver 70 corresponds to a setup position for a particular club. Input device I may include a user interface, such as a keyboard K, as best shown in FIG. 15, or stylus. A user may define each position by associating a selected club with a particular receiver. For example, the user may define activation of central receiver 70*a* as "PUTT", so that upon activation of central receiver 70*a*, "PUTT" will be displayed on display D of input device I. In this way, the user may 'teach' the system which club to associate with a particular foot position.

System 60 may also include an indicator device that is in communication the sensor. As described above, the sensor transmits a command signal to the indicator upon activation of a particular receiver 70. The indicator device is actuated upon receipt of the command signal. Upon actuation, the indicator device provides an audible, visible and/or tactile response.

A user may disable activation of one or more of receivers 70 using the associated user interface to ensure that the indicator device is not actuated unless the golfer's feet are properly positioned and aligned. For example, the user may select "PUTT", which disables activation of all receivers 70 except for central receiver 70*a*. Thus, the indicator device will only be actuated if transmitter 66 is aligned with central receiver 70*a*. In this way, first and second shoes 62, 64 must be properly aligned in a 'putting stance' in order for the indictor device to actuate. Preferably, indicator device is a light emitting device 30 as described above, though other visible, audible and/or tactile indicator devices may also be used.

Many golfers do not set up "exactly square" when striking the ball. As is commonly understood, golfers come in many shapes, sizes and abilities. People often adapt the "traditional" swing and setup due to differences in body shape, age, flexibility, ability, physical limitations, etc. System 60 accounts for such variations by allowing the user to define when a particular receiver 70 will be activated by linking activation of that particular receiver with a particular position. The particular position, in turn, may be defined by a particular club. Thus, activation of the particular receiver 70 indicates that shoes 62, 64 are properly aligned for the desired club. Because the user may 'teach' the system, system 60 may be tailored to a particular golfer's style, build, flexibility, etc.

A golf instructor could also use system 60 with a golf student to instruct the student the proper alignment or position of his or her feet and stance. The instructor could then associate activation of a particular receiver 70 with a particular club using input device I, thereby "teaching" system 60 the desired positions. The student could thereafter select a particular club or stance (for example "PUTTING") on the display D using a conventional user interface. When the student's feet are properly aligned, the indicator (such as light emitting device 30) would be actuated. Thus, the student could practice proper stance without the supervision of the instructor. System 60 could also be integrated into the many software-based teaching packages utilized by golf instructors today.

Figure 16:
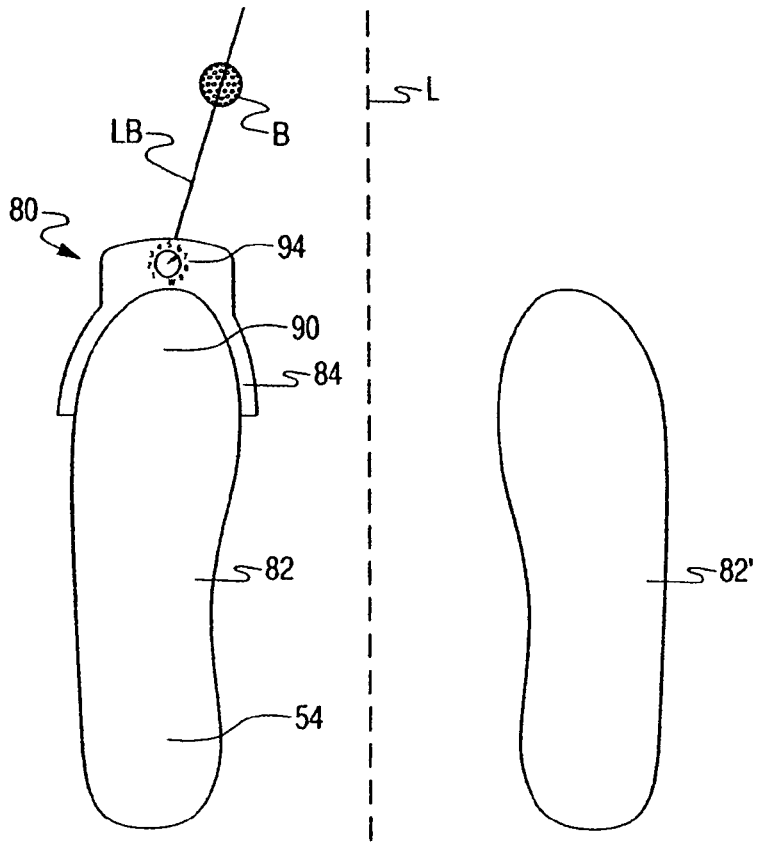
FIG. 16 is a schematic view of a golf alignment device according to another embodiment.
Figure 17:
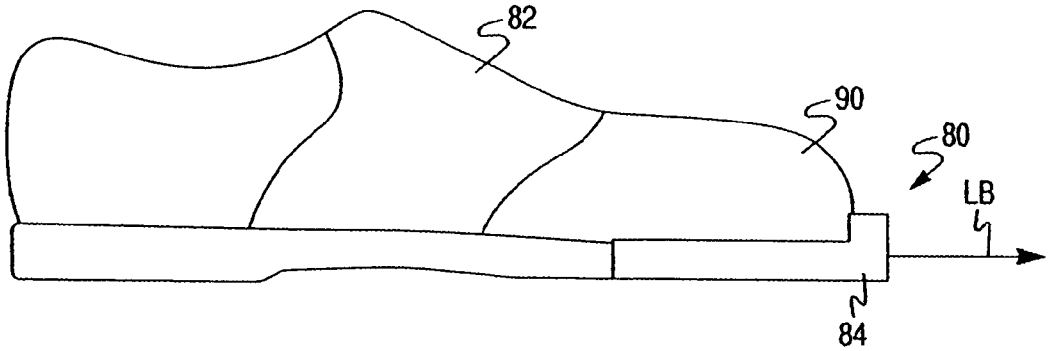
FIG. 17 is a side elevational view of the golf shoe and alignment device according to the embodiment shown in FIG. 16.
Figure 19:
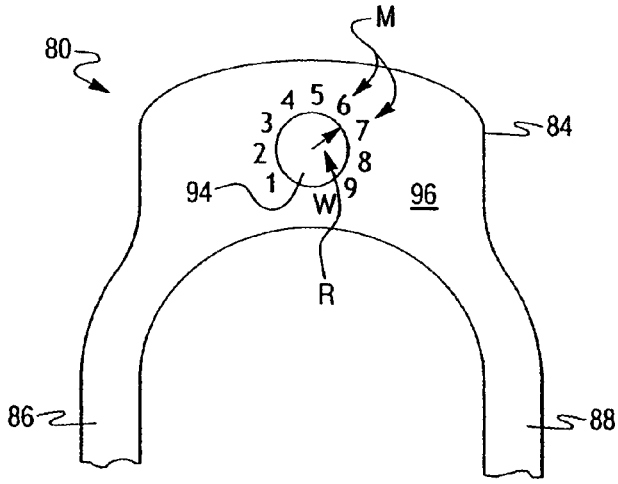
FIG. 19 is a fragmentary top plan view of the alignment device according to the embodiment shown in FIG. 16.

A golf alignment device 80 according to a third embodiment is best shown in FIGS. 16, 17 and 19. Device 80 is configured to be attached to a golf shoe 82, having a U-shaped housing 84 having first and second legs 86, 88 which are clipped around a toe portion 90 of shoe 82. Device 80 is preferably removably attached to golf shoe 82, so that any shoe may be retrofitted with device 80. However, device 80 may also be permanently affixed to golf shoe 82 if desired.

Figure 18:
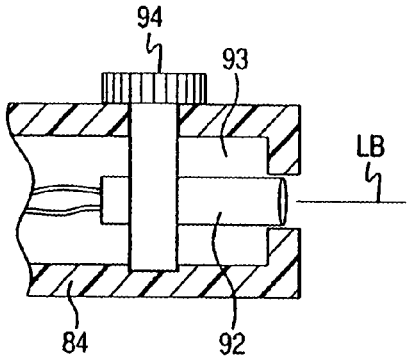
FIG. 18 is a fragmentary cross-sectional view of the alignment device according to the embodiment shown in FIG. 16.
Figure 18A:
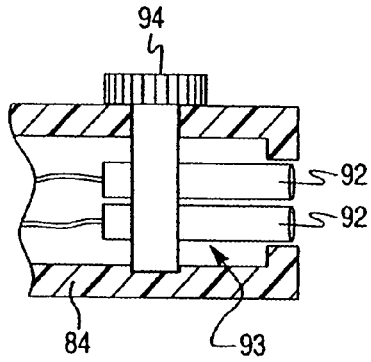
FIG. 18A is a fragmentary cross-sectional view of an alignment device according to another embodiment.
Figure 20:
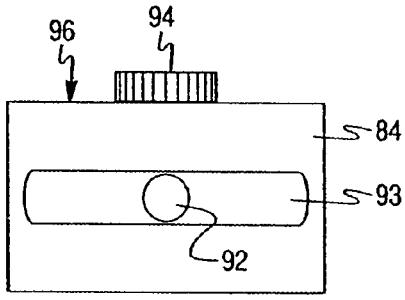
FIG. 20 is a front elevational view of the alignment device according to the embodiment shown in FIG. 16.
Figure 21:
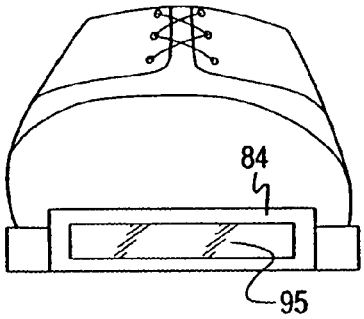
FIG. 21 is a front elevational view of the alignment device according to the embodiment shown in FIG. 16 with a window covering a cavity opening.
Figure 21A:
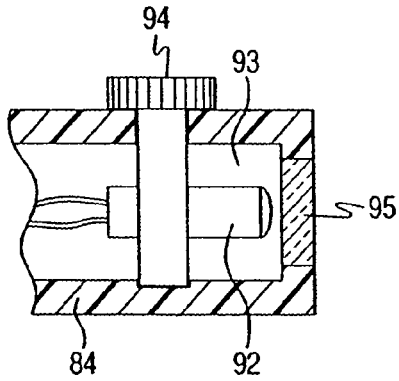
FIG. 21A is a fragmentary cross-sectional view of the alignment device with a window clipped onto the housing.

As shoe in FIG. 16, device 80 is attached to a left-footed shoe. However, device 80 may also be attached to a right-footed shoe 82' if desired. A light emitting device 92 is pivotally attached to housing 84, as best shown in FIG. 18. Light emitting device 92 is preferably removably secured within a cavity 93 of housing 84, as best shown in FIGS. 18 and 20. Light emitting device 92 may emit a laser, such as a battery powered pointer, that emits a visible light beam. Laser emitting device 92 may include a deflector or prism which deflects the laser beam to appear as a visible wall having a predetermined height. In this way, the laser beam will extend outwardly from the user even if the ground is uneven. Alternatively, two vertically spaced light emitting devices 92 may be disposed within device 80, which produce parallel laser beams, as best shown in FIG. 18A. Thus, a relatively inexpensive light emitting device 92 may be inserted into a pivotally attached holster within cavity 93. Light emitting device 92 may then be easily removed and replaced if damaged or for battery replacement. A window 95 may be clipped onto housing 84 which encloses cavity 93, as best shown in FIGS. 21 and 21A. Window 95 permits the light beam LB from light emitting device 92 to pass through, while protecting light emitting device 92 from damage. Window 95 also minimizes the chance of any debris from entering cavity 93.

Light emitting device 92 projects a light beam LB in a straight line extending outwardly from toe portion 90, as best shown in FIG. 16. The direction of the light beam LB may be adjusted by pivoting light emitting device 92. Light emitting device 92 may be pivotally attached so that the light beam may be adjusted 180°. Thus, the light beam LB may extend substantially perpendicular to and away from a center line L (shown in dashed line) of a golfer when the golfer is in a square position, substantially parallel to the center line L, or substantially perpendicular to and toward the center line L (relative to the lead foot of the golfer) when in a square position. Thus, the angle of the light beam LB emitted from a golfer's lead foot relative to center line L may be changed in accordance with the user's or instructor's preferences, and depending on the particular club being played.

Device 80 preferably includes an indicator dial 94 disposed on an upper surface 96 of housing 84, as best shown in FIG. 19. Indicator dial 94 may be connected to light emitting device 92, so that rotation of indicator dial 94 causes light emitting device 92 to rotate. Indicator dial 94 may include a reference arrow R which aligns with markings M on housing 84. Preferably, indicator dial 94 includes a positive detent mechanism so that arrow R clicks into a position aligned with one of markings M. Markings M indicate predetermined directions in which the light beam LB projects when reference arrow is aligned therewith. For example, markings M may include numbers 3 through 9 (corresponding to the 3-iron, 4-iron, 5-iron, and so forth), and letters D (corresponding to the driver) and PW (corresponding to the pitching wedge). If a golfer wants to align the ball in the center of his stance (along center line L), indicator dial 94 is rotated until arrow R is aligned with marking number "7". The rotation of indicator dial 94 causes light emitting device 92 to pivot so that the projected light beam LB extends outwardly at a predetermined angle relative to center line L. The golfer's stance is adjusted so that the light beam extends toward and/or into the desired target, such as the ball B, as best shown in FIG. 16. It should be understood that markings M on indicator dial 94 need not indicate the club being used. For example, markings M may indicate the position or angle of the light beam.

Indicator dial 94 may be directly connected to light emitting device 92, so that manual rotation of dial 94 causes light emitting device 92 to pivot. Alternatively, device 80 may include a motor operatively associated with light emitting device 92 and in communication with a sensor. The sensor is in communication with an input device I, such as shown in FIGS. 13 and 14. A user selects a particular club on a display with a user interface. Upon making a selection, a signal is transmitted to the sensor, which causes the motor to rotate light emitting device 92 to a predetermined position. A series of predetermined positions are provided, which correspond to a particular selection. Following rotation of light emitting device 92 to the predetermined position via actuation of the motor, the light beam LB is projected outwardly in a corresponding direction. Each direction may be associated with the selection of a particular club. While the input device may be a wrist or hand-held PDA, it could also be a controller with a series of buttons, each button corresponding to a particular club (and therefore light beam direction).

Alternatively, device 80 could include a plurality of light emitting devices 92 disposed at various angles within housing 84, each device 92 being in communication with a sensor. The sensor would be in communication with an input device I. The particular light emitting device 92 activated would be selected by the user, thereby selecting the angle at which the light beam LB projects. Further, the user could selectively associate activation of each light emitting device 92 with an angle, and therefore a particular club, using an associated user interface as described above. In this way, a user could 'teach' device 80 the angle of projection of a light beam to associate with a selected club. Thus, device 80 could be customized by the user to suit his or her particular style. The golfer could practice at a facility after light emitting devices 92 had been associated with particular clubs without supervision of a professional instructor.

Many golfers play lower irons and woods closer toward their lead foot, middle irons in the center of their stance, and higher irons and wedges toward their other (non-lead) foot. Thus, as indicator dial 94 is rotated from lower irons (and woods) to middle irons, the angle relative to center line L increases. For higher irons and wedges, the golfer may align the ball with the light beam, but position his or her body so that the ball is closer to the non-lead foot.

Device 80 aids the golfer with proper ball positioning with respect to his or her lead foot. In addition, device 80 may be used for providing a reference line toward a desired target by pivoting light emitting device 92 so that the light beam extends outwardly toward the target and substantially perpendicular to center line L.

Figure 22:
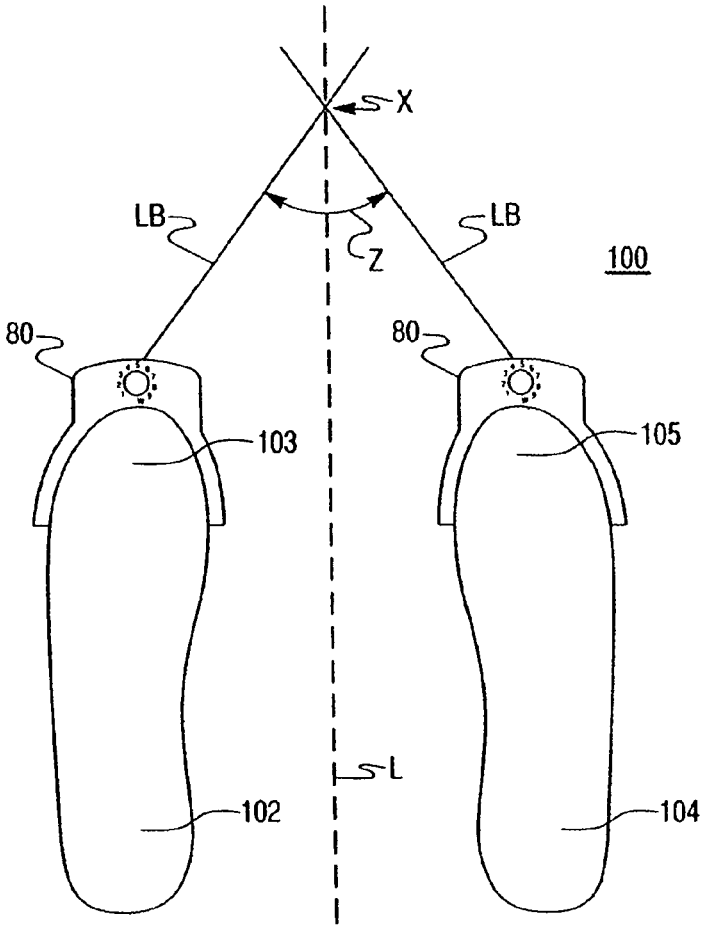
FIG. 22 is a schematic view of another embodiment with light beams projecting in a first orientation.

Center line L is not a visible reference line for a golfer. Therefore, it may be advantageous to provide a visible intersection point for aligning the ball B. In order to provide an intersection point, a golf alignment system 100 according to a fourth embodiment is provided, as best shown in FIG. 22. System 100 is particularly helpful in aiding a golfer with proper ball position, and maintaining consistent ball placement for his or her particular body type, set-up, stance, etc.

System 100 includes first and second shoes 102, 104. A light emitting device 80 is pivotally attached to each shoe 102, 104. Each device 80 is preferably attached proximate toe portions 103, 105 of shoes 102, 104, respectively. Each device 80 projects a light beam in a straight line extending outwardly therefrom. Each of devices 80 on shoes 102, 104 may be adjusted so that the light beam from device 80 on first shoe 102 may extend in a first direction, and the light beam from device 80 on second shoe 104 may extend in a second direction. Devices 80 on first and second shoes may be adjusted so that their associated light beams intersect. The light beams intersect at a point X in front of the golfer. For example, devices 80 may be adjusted so that the light beams intersect along the center line L, thereby indicating the center of the golfer's stance when the golfer is in a square set up position relative to a target line. The golfer may align his or her body in a desired position, such as a forward or a backward position relative to the ball, using the intersection point as a reference position. The golfer may then play the ball from the intersection point, at a position behind the intersection point (relative to the golfer's lead foot), or at a position in front of the intersection point (relative to the golfer's lead foot) depending on the type of shot and club selected.

The intersecting beams define an angle Z. Angle Z may correspond to a particular club selection best suited for that position, which is defined at the intersection point of the beams. For example, a 7-iron may be played in the center of the stance of a golfer (i.e. along center line L). Indicator dial 94 on shoe 102 is rotated to a marking M which indicates that the user has pivoted light emitting device 92 to a position for aligning the ball position when swinging a 7-iron. Indicator dial 94 on shoe 104 is also rotated to a marking M which corresponds to a position for aligning the ball position when swinging the 7-iron. Note that devices 80 on shoes 102, 104 would therefore be calibrated so that markings M on indicator dial 94 on shoe 102 (or 104) corresponded to the golfer's lead foot. Markings M on indicator dial 94 on shoe 104 (or 102) would correspond to the golfer's trailing foot. Thus, the calibration of device 80 would vary depending on whether it was for use with the lead foot or the trailing foot. As the beam is moved in the direction of the lead (or trailing) foot, indicator dial 94 is rotated to correspond to the desired club selection.

Figure 23:
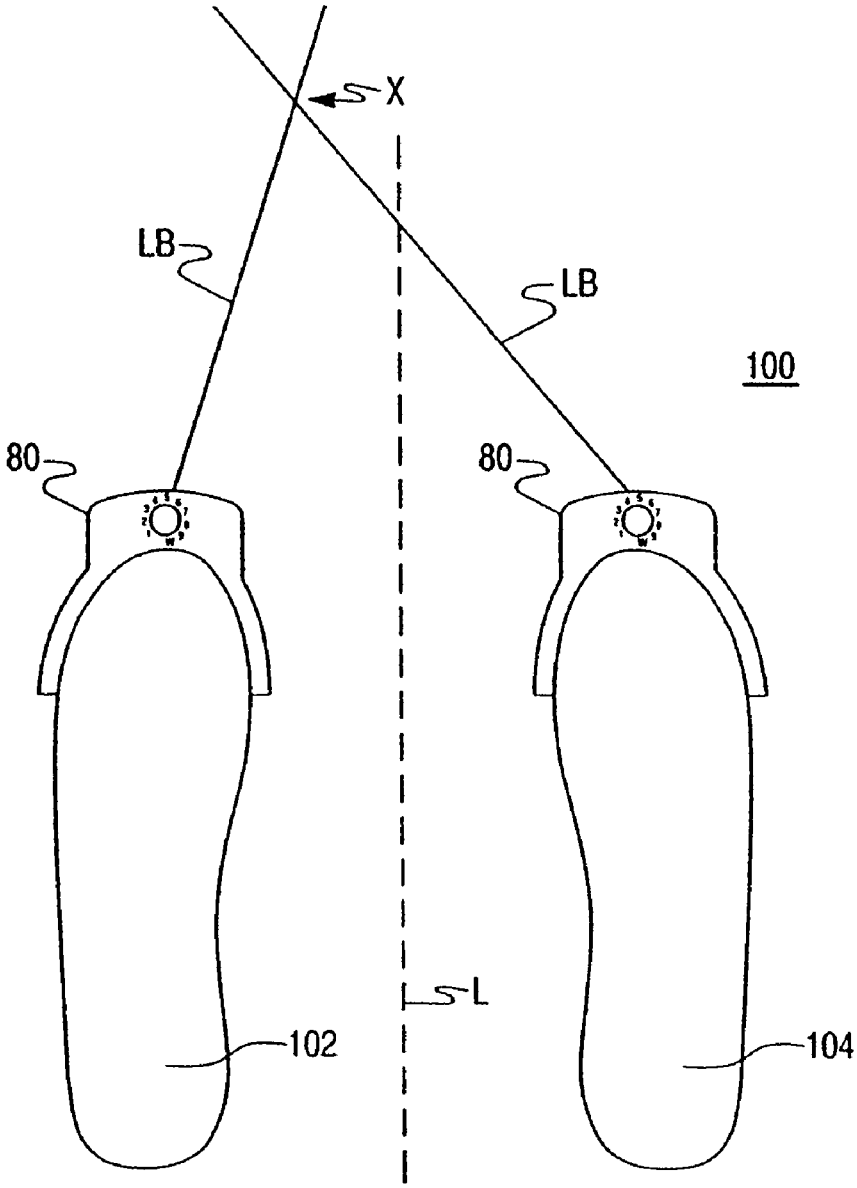
FIG. 23 is a schematic view of the embodiment shown in FIG. 22 with light beams projecting in a second orientation.

For example, the ball B is typically aligned with the left heel (of a right-handed golfer) when playing the driver, as best shown in FIG. 23. Indicator dial 94 on shoe 102 is rotated to a marking M which indicates that the user has pivoted light emitting device 92 to a position for aligning the ball position when swinging a driver. Indicator dial 94 on shoe 104 is also rotated to a marking M which corresponds to a position for aligning the ball position when swinging the driver. Light emitting devices 92 are thereby rotated so the their corresponding light beams are projected at predetermined angles relative to center line L. The intersection point X is aligned with the left heel of the golfer.

Figure 24:
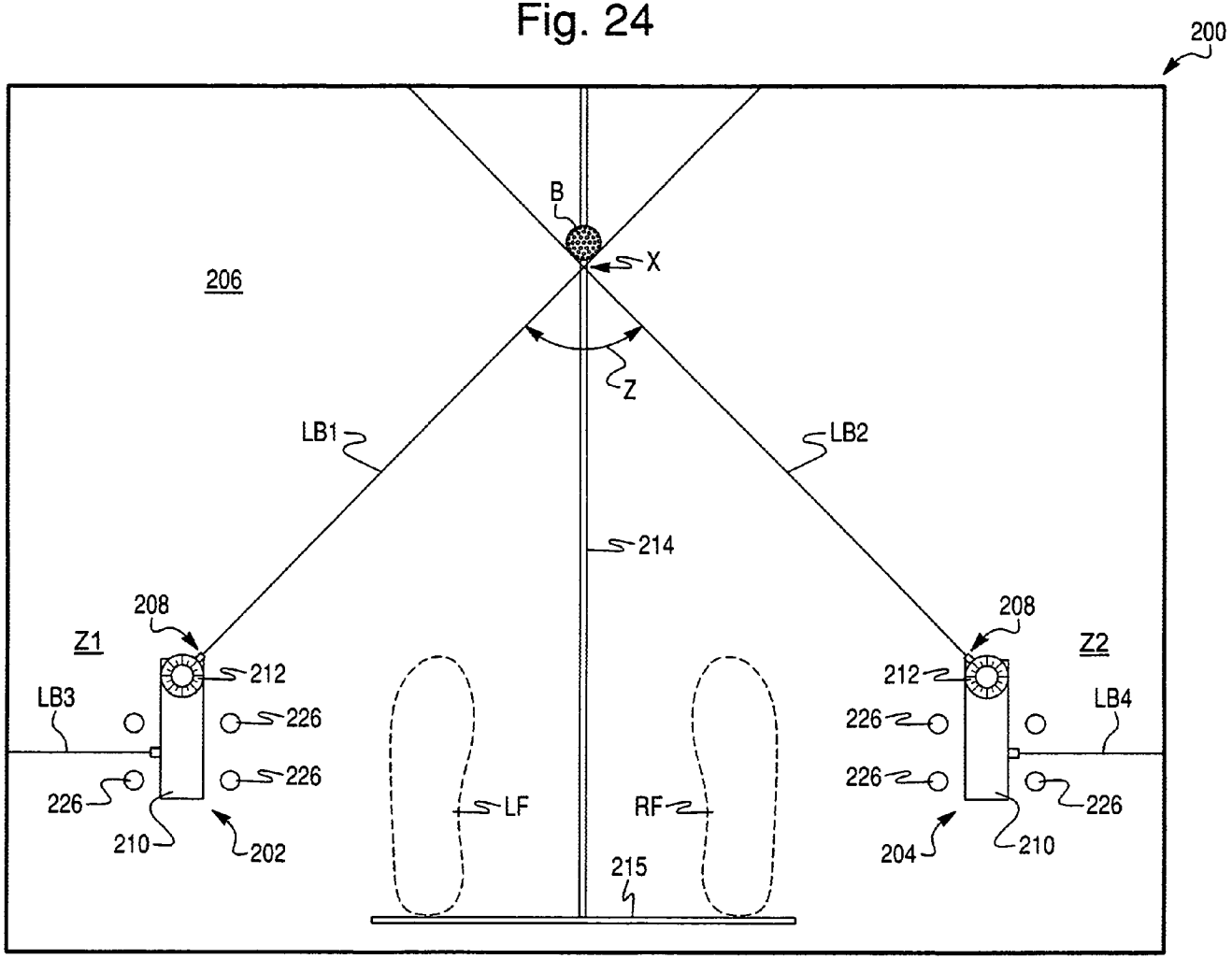
FIG. 24 is a plan view of a golf practice system according to another embodiment, with a golfer's feet shown in phantom.
Figure 28:
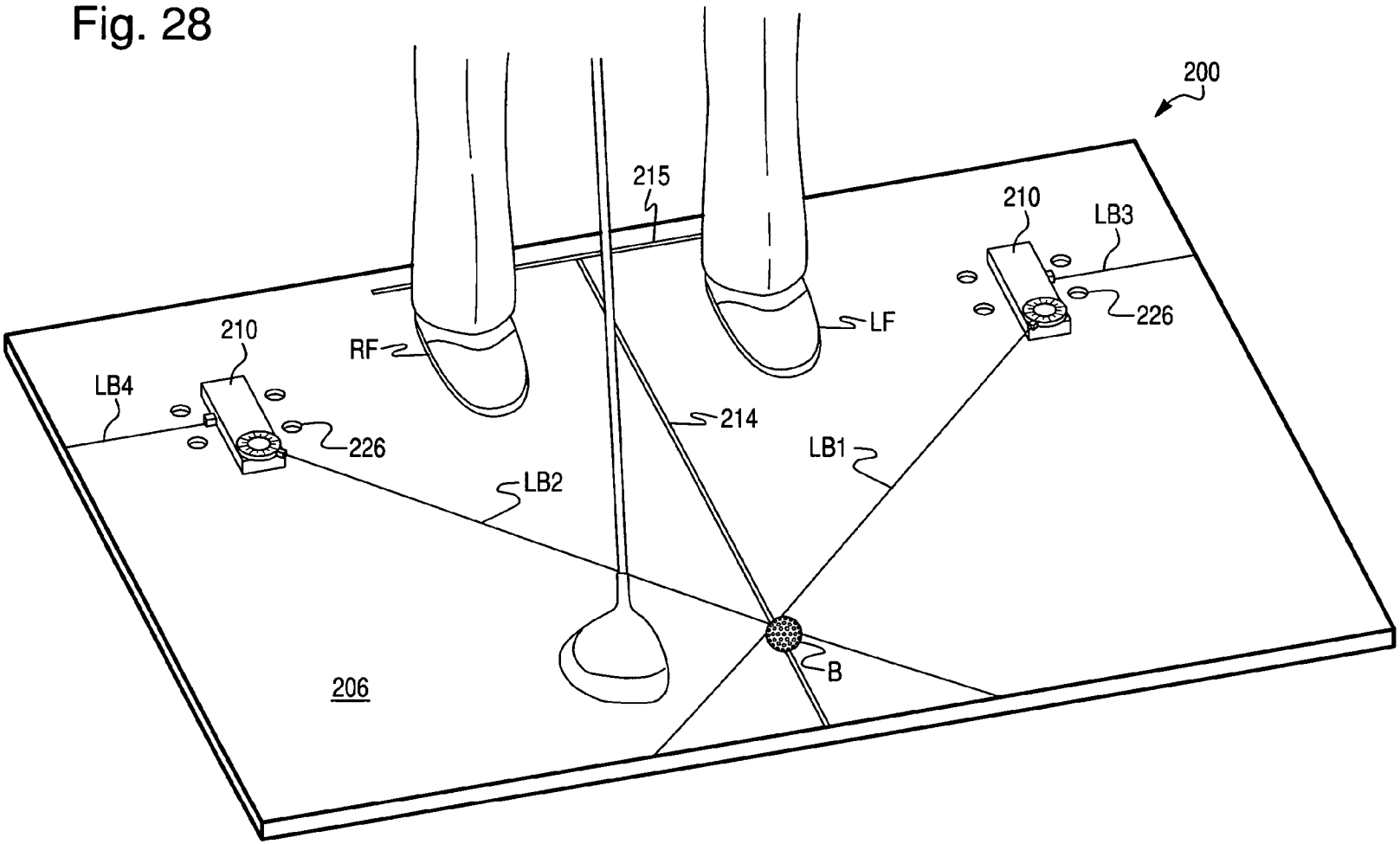
FIG. 28 is a perspective view of the golf practice system of FIG. 24.

A golf practice system 200 according to another embodiment is best shown in FIGS. 24 and 28. System 200 preferably includes first and second alignment devices 202, 204 which may detachably mounted to a golf practice mat 206. Alternatively, alignment devices 202, 204 may be permanently affixed to golf practice mat 206.

Figure 25:
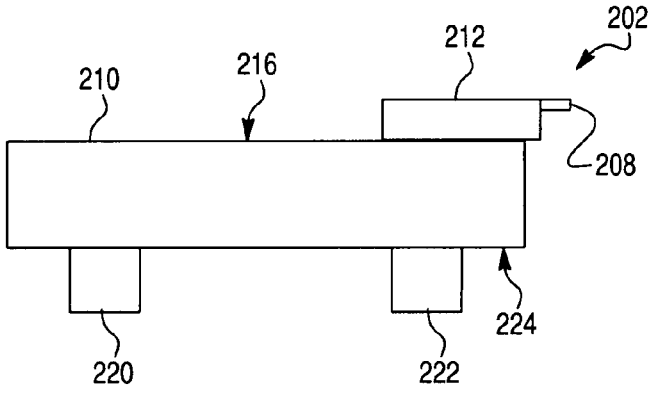
FIG. 25 is a side elevational view of an alignment device according to the present invention.

First alignment device 202 includes a light emitting device 208 rotatably attached to a base 210, as best shown in FIG. 25. Light emitting device 208 preferably emits a visible laser beam, such as described above for laser emitting device 92. A relatively inexpensive light emitting device 208 may be inserted into a correspondingly configured chamber provided within a housing 212 that is rotatably attached to base 210. Alternatively, light emitting device 208 may be integrally formed with housing 212 and/or secured to housing 212. Second alignment device 204 is preferably similarly configured, and includes a second light emitting device 208 rotatably attached to another base 210, as shown in FIGS. 24 and 28.

Light emitting device 208 of first alignment device 202 projects a light beam LB 1 in a straight line extending outwardly from housing 210. The direction of the light beam LB1 may be adjusted by rotating housing 212. For example, housing 212 (and thus light emitting device 208) may be rotatably attached to base 210 so that the light beam LB1 may be adjusted 180° or more. Thus, the light beam LB 1 may extend substantially perpendicular to and away from a center line 214 provided on mat 206. Note that mat 206 need not include center line 214. Alternatively, mat 206 may include additional lines for aiding the golfer in alignment. For example, mat 206 may include a side line 215 disposed proximate an edge of mat 206, which may be substantially perpendicular to center line 214 for aligning the golfer's heels, as shown in FIG. 24. The angle of the light beam LB 1 emitted from first alignment device 202 may be adjusted relative to center line 214 and/or a golfer's feet RF, LF in accordance with the user's or instructor's preferences, and depending on the particular club being played.

Likewise, light emitting device 208 of second alignment device 204 projects a second light beam LB2 in a straight line extending outwardly from base 210. The direction of the light beam LB2 may be adjusted by rotating housing 212 and/or light emitting device 208. The angle of the light beams LB1, LB2 emitted from first and second alignment devices 202, 204 may be adjusted relative to center line 214 as well as each other.

Thus, first alignment device 202 may be adjusted so that light beam LB1 projecting therefrom extends in a first direction, and second alignment device 204 may be adjusted so that light beam LB2 projecting therefrom extends in a second direction. First and second alignment devices 202, 204 may be adjusted so that their associated light beams LB1, LB2 intersect at a point X in front of the golfer. The golfer may align his or her body in a desired position, such as a forward or a backward position relative to a golf ball B positioned on mat 206, using the intersection point X as a reference position. The golfer may then play the ball B from the intersection point X, at a position behind the intersection point X (relative to the golfer's lead foot), or at a position in front of the intersection point X (relative to the golfer's lead foot) depending on the type of shot and club selected. Moreover, the intersecting beams LB1, LB2 define an angle Z, as described above. Angle Z may correspond to a particular club selection best suited for that position, which is defined at the intersection point X of the light beams LB1, LB2.

Figure 26:
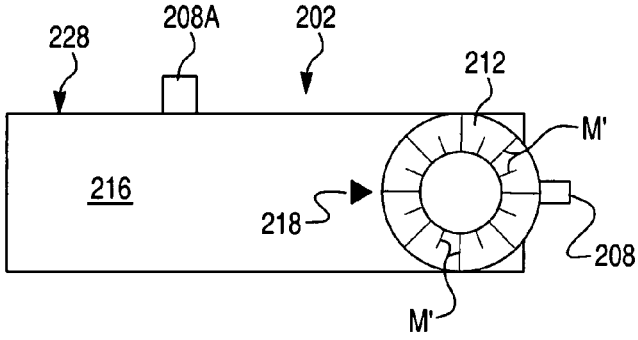
FIG. 26 is a top view of the alignment device of FIG. 25.

Alignment devices 202, 204 preferably include an indicator dial disposed on an upper surface 216 of base 210. As best shown in FIG. 26, housing 212 may be configured as an indicator dial, while also including a correspondingly configured cavity for retaining light emitting device 208. Alternatively, a separate indicator dial may be provided that is connected to light emitting device 208. In either case, rotation of housing 212 (or indicator dial) causes light emitting device 208 to rotate. A reference arrow 218 may be provided on upper surface 216 of base 210, which aligns with markings M' on housing 212 (or indicator dial). Similar to indicator dial 94, housing 212 may include a positive detent mechanism so that reference arrow 218 clicks into a position aligned with one of markings M'. Markings M' indicate predetermined directions in which the light beam LB1 (or LB2) projects when reference arrow 218 is aligned therewith.

Thus, the rotation of housing 212 (or indicator dial) causes light emitting device 208 to rotate so that the projected light beam LB1 (or LB2) extends outwardly at a predetermined angle relative to center line 214 and/or the golfer's feet RF, LF. The golfer's stance is adjusted so that the light beam extends toward and/or into the desired target, such as the ball B, as best shown in FIG. 24.

Housing 212 (or indicator dial) may be manually rotated to a desired position by the golfer. Alternatively, alignment device 202 (or 204) may include a motor operatively associated with light emitting device 208 and in communication with a sensor. The sensor may be in communication with an input device, such as input device I as shown in FIGS. 13-15. A user selects a particular club on a display with a user interface. Upon making a selection, a signal is transmitted to the sensor, which causes the motor to rotate light emitting device 208 to a predetermined position. A series of predetermined positions are provided, which correspond to a particular selection. Following rotation of light emitting device 208 to the predetermined position via actuation of the motor, the light beam LB1 (or LB2) is projected outwardly in a corresponding direction. Each direction may be associated with the selection of a particular club.

Thus, an external controller may communicate with alignment devices 202, 204 to ascertain or "learn" the current position (or setting) of the corresponding light emitting devices 208 in order to associate the position (or setting) with a desired club. The learned information may be stored at a practice facility on a central computer, or stored on a portable storage medium such as a smart chip, magnetic card, or the like. Upon returning to the practice facility, the golfer may retrieve the learned information from the storage medium, such as by insertion of the portable storage device into an associated reader device or by logging into a master control system. The 'learned' ball positions may then be selected by the user for a particular club using an input device I. Alignment devices 202, 204 are then automatically rotated by associated motors to the selected positions for each selected club for the individual user. Alternatively, the user's prior 'learned' desired setting may be displayed on a display so that the golfer may manually adjust the positions of light emitting devices 208. Once the golfer (and/or instructor) has 'taught' the external controller the various desired ball positions for each club, the golfer may return to the practice facility and successfully practice without requiring the supervision of an instructor to establish the desired ball position.

First and second alignment devices 202, 204 preferably each include first and second projections 220, 222 extending from an underside 224 of base 210, as best shown in FIG. 25. Projections 220, 222 may be an integrally formed portion of base 210, or separate components secured to underside 224. Projections 220, 222 may be received in a correspondingly configured pair of mounting apertures 226 disposed in mat 206. Note that mat M may include more than one set of mounting apertures 226, so that alignment device 202 (or 204) may be detachably secured to mat 206 in a selected position. As shown in FIG. 24, mat 206 includes three sets of mounting apertures 226 within a first zone Z1 proximate a first side of mat 206, and three sets of mounting apertures 226 within a second zone Z2 proximate a second side of mat 206. Alignment devices 202, 204 are detachably disposed in the center pair of mounting apertures 226 in each of first and second zones Z1, Z2, respectively.

It should be understood that fewer or more mounting apertures 226 may be provided in mat 206 as described above. Moreover, other methods of securing alignment devices 202, 204 to mat 206 may be implemented, such as hook and loop fasteners, depressions in mat 206 in which alignment device 202, 204 rest, pins extending from mat 206 which are received in cavities in devices 202, 204 (or vice versa), etc. In addition, practice system 200 may be constructed so as to be portable, or may be permanently secured to a surface, such as within a practice facility. Thus, practice system 200 may be constructed so as to be used on an artificial practice surface.

Alternatively, first and second alignment devices 202, 204 may be configured so as to be used on a grass surface. For example, alignment devices 202, 204 may include projections extending from underside 224 of base 210 which are configured to be removably driven into the ground, thereby eliminating the need for mat 206.

Thus, alignment devices 202, 204 may be removably driven into the ground or positioned on mat 206 at selected positions to the right and left of a golfer when setting up golf practice system 200. Note that alignment devices 202, 204 may also be permanently affixed to a surface, such as a floor or wall of a practice facility. For example, a practice facility may include a plurality of practice stations, wherein each station includes affixed alignment devices 202, 204 operable by a golfer.

Each of first and second alignment devices 202, 204 may also include a second light emitting device 208A disposed within a correspondingly configured cavity in base 210, and which projects a light beam outwardly from an outer side 228 thereof, as best shown in FIGS. 24 and 26. For example, second light emitting devices 208A of first and second alignment devices 202, 204 may emit light beams LB3, LB4, respectively, which are transverse relative to the golfer and/or perpendicular to center line 214, as shown in FIGS. 24 and 28. Transverse light beams LB3, LB4 may provide additional alignment assistance to an intended target.

Figure 27:
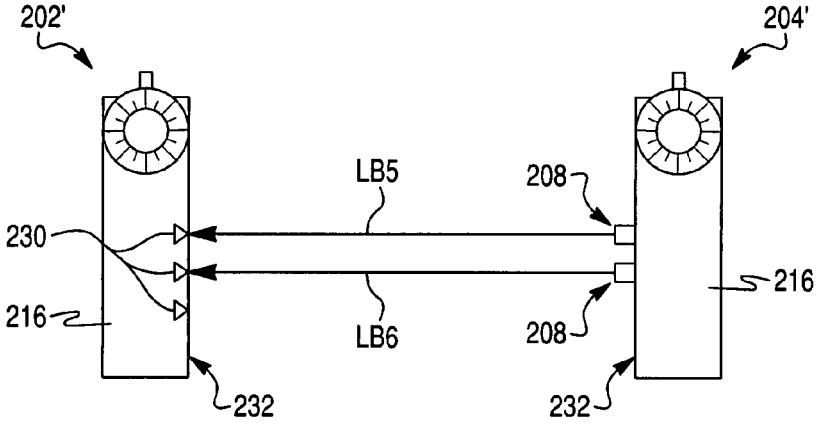
FIG. 27 is a plan view of first and second alignment devices according to an embodiment of the present invention.

In another embodiment, a first alignment device 202' may include alignment marks 230 disposed on upper surface 216 and proximate an inner side 232, as shown in FIG. 27. A second alignment device 204' may include one or more additional light emitting devices 208 disposed within correspondingly configured cavities within base 210 which project light beams outwardly from an inner side 232 thereof. For example, second alignment device 204 may include two light emitting devices 208 which project light beams LB5, LB6 outwardly from inner side 232. First alignment device 202' may be aligned with second alignment device 204' by aligning light beams LB5, LB6 with selected reference arrows 230. Alternatively, non-visual transmitter/receiver methodologies may be employed to confirm that first and second alignment devices 202, 204 are in preferred alignment with each other, such as a radio frequency transmitter/receiver as described above.

Golf practice system 200 may be integrated into various practice facilities. One such facility includes technology wherein the golf balls are embedded with RFID tags in order to track location and travel distance within the driving range. By integrating the disclosed system 200 with the technology of such facilities, data may be gathered and stored regarding the distance traveled by a golf ball when struck by a particular club at a particular ball position. The golfer may also select a particular manufacturer and model of golf club including loft, shaft stiffness, etc. By tracking and storing performance data and ball position when practicing, the golfer may also determine which golf club model is optimal for the golfer using practice system 200. Thus, the disclosed invention may also be integrated into current club-fitting technologies and systems known in the industry.

The disclosed inventions thereby allow the golfer to repeatedly achieve visible reference information with regard to proper ball positioning. Further, by merging the disclosed inventions with other known technologies, the golfer may determine the optimal club performance and ball position for his or her golfing enjoyment. The disclosed inventions provide a golfer with a visible, audible and/or tactile indication of proper alignment with respect to an intended target line, ball position, stance or address position. The inventions have been described with reference to various embodiments. However, it will be apparent to one of ordinary skill in the art that various modifications and variations can be made in construction or configuration of the present invention without departing from the scope or spirit of the invention.

Furthermore, features described with respect to one embodiment may be incorporated into another embodiment. For example, a shoe may include light emitting devices disposed on an instep portion thereof, as shown in FIGS. 7-9, which are aligned with reference marks on a second shoe, as shown in FIGS. 6, 10, 11. In addition, one of both of the shoes may also include a light emitting device on the top portion thereof, which produce(s) a visible line extending outwardly from the user toward the ball, or toward a target. Thus, features of the one of the disclosed embodiments may be incorporated into another of the disclosed embodiments.

For example, any of the indicator devices used in the disclosed embodiments may be provided as a retrofit or clip-on type attachment for a golf shoe. Alternatively, the indicator device could be integrated into a golf shoe, or the indicator device could be integrated into a detachable sole that is removably attached to a shoe. The light emitting devices could be positioned proximate the toe portion of a shoe, as described for some embodiments, along the instep, or proximate a heel portion of a shoe. Furthermore, the present invention may include an indicator that is attachable to either a golf shoe or regular "street shoes."

Thus, it is intended that the present invention cover all such modifications and variations, provided they come within the scope of the following claims and their equivalents.

I claim:

1. A golf practice system, comprising:

a practice mat having first and second opposite sides;

a first alignment device having a first light emitting device rotatably attached to a first housing and rotatable about a vertical axis, said first alignment device secured to said mat proximate said first side, said first light emitting device projecting a first light beam in a straight line extending outwardly in an adjustably selected first direction and defining a first visible reference line, wherein said first alignment device is selectively positionable on said practice mat; and a second alignment device having a second light emitting device rotatably attached to a second housing and rotatable about a vertical axis, said second alignment device secured to said mat proximate said second side, said second light emitting device projecting a second light beam in a straight line extending outwardly in an adjustably selected second direction and defining a second visible reference line, wherein said second alignment device is selectively positionable on said practice mat.

2. The golf practice system of claim 1, wherein said first alignment device includes an indicator dial coupled to said first light emitting device for selectively adjusting the first direction.

3. The golf practice system of claim 2, wherein said second alignment device includes an indicator dial coupled to said second light emitting device for selectively adjusting the second direction.

4. The golf practice system of claim 3, wherein each of said indicator dials includes markings that correspond to predetermined angles.

5. The golf practice system of claim 1, wherein the first light beam is projected independently of the second light beam, and the first light beam intersects the second light beam to form a visible intersection point defining a particular angle when said first and second light emitting devices are in a predetermined position.

6. The golf practice system of claim 1, further comprising a first motor for causing said first light emitting device to pivot to a selected position and a second motor for causing said second light emitting device to pivot to a selected position.

7. The golf practice system of claim 6, further comprising a controller operatively associated with and remote from said first and second motors, said controller causing said first and second light emitting devices to pivot to selected positions via actuation of the corresponding motors.

8. The golf practice system of claim 7, wherein said controller includes a display for displaying the selected positions.

9. The golf practice system of claim 8, wherein said display indicates a recommended club corresponding to each selected position.

10. The golf practice system of claim 9, wherein said controller includes a user interface associated therewith, and the user may define the recommended club via an associated user interface.

11. The golf practice system of claim 6, further comprising an input device in communication with said first and second alignment devices, wherein said input device is capable of sending a signal to said first and second alignment devices which causes said first and second motors to rotate said first and second light emitting devices, respectively, to a predetermined position.

12. The golf practice system of claim 1, further comprising:

at least one transmitter disposed on a side surface of said first alignment device, said transmitter for transmitting a signal;

at least one receiver disposed on a side surface of said second alignment device, said receiver activated by the signal when said first alignment device is in a predetermined position relative to said second alignment device;

a sensor in communication with said receiver and sensing activation of said receiver, said sensor generating a command signal if said receiver is activated; and an indicator in communication with said sensor, said indicator actuated after receiving the command signal.

13. The golf practice system of claim 12, wherein said transmitter is a light emitting device attached to first alignment device that projects a light beam.

14. The golf practice system of claim 12, wherein said indicator is audible.

15. A golf practice system, comprising:

a first alignment device having a first light emitting device rotatably attached to a first housing and rotatable about a vertical axis, said first light emitting device projecting a first light beam in a straight line extending outwardly in an adjustably selected first direction and defining a first visible reference line, wherein said first alignment device is selectively positionable on a surface;

at least one transmitter disposed on a side surface of said first alignment device, said transmitter for transmitting a signal;

a second alignment device having a second light emitting device rotatably attached to a second housing and rotatable about a vertical axis, said second alignment device spaced from said first alignment device, said second light emitting device projecting a second light beam in a straight line extending outwardly in an adjustably selected second direction and defining a second visible reference line, wherein said second alignment device is selectively postionable on a surface;

at least one receiver disposed on a side surface of said second alignment device, said receiver activated by the signal when said first alignment device is in a predetermined position relative to said second alignment device;

a sensor in communication with said receiver and sensing activation of said receiver, said sensor generating a command signal if said receiver is activated; and an indicator in communication with said sensor, said indicator actuated after receiving the command signal.

16. The golf practice system of claim 15, wherein said transmitter is a secondary light emitting device attached to said first alignment device that projects a light beam in a straight line.

17. The golf practice system of claim 16, wherein said indicator is audible.

18. The golf practice system of claim 15, further comprising an external controller, wherein the external controller communicates with the first and second alignment devices to store a set position for a particular club.

19. A method of positioning and aligning a golf ball, comprising the steps of:

providing a first alignment device having a light emitting device rotatably attached to a base, the light emitting device projecting a light beam in a straight line extending outwardly therefrom and defining a first visible reference line;

selectively positioning the first alignment device on a surface;

providing a second alignment device having a light emitting device rotatably attached thereto, the light emitting device projecting a light beam in a straight line extending outwardly therefrom and defining a second visible reference line;

selectively positioning the second alignment device on a surface;

rotating the first and second light emitting devices about vertical axis to predetermined positions, so that the first and second visible reference lines intersect at an intersection point; and positioning a golf ball relative to the intersection point.

20. The method of claim 19, including the further step of associating a particular club with the predetermined position.

* * * * *